US006871038B2

(12) United States Patent
Fujiwara

(10) Patent No.: US 6,871,038 B2
(45) Date of Patent: Mar. 22, 2005

(54) IMAGE FORMING APPARATUS AND BELT ROTATING DEVICE

(75) Inventor: Yumi Fujiwara, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/617,030

(22) Filed: Jul. 11, 2003

(65) Prior Publication Data

US 2004/0076455 A1 Apr. 22, 2004

(30) Foreign Application Priority Data

Jul. 15, 2002 (JP) ..... 2002-205629

(51) Int. Cl.[7] ..... G03G 15/00; G03G 15/16

(52) U.S. Cl. ..... 399/303; 198/840; 399/162; 399/302; 399/313

(58) Field of Search ..... 399/302, 303, 399/308, 313, 162, 165, 167; 198/804, 806, 835, 837, 838, 840

(56) References Cited

U.S. PATENT DOCUMENTS 5,017,969 A * 5/1991 Mitomi et al. ..... 198/835 X
6,053,307 A * 4/2000 Honda ..... 198/840 X
6,097,922 A * 8/2000 Munenaka ..... 399/303 X
6,453,143 B2 * 9/2002 Takeuchi ..... 399/303
2002/0021920 A1 * 2/2002 Hayakawa et al. ..... 399/303
2002/0046932 A1 * 4/2002 Wakana ..... 198/840
2003/0175056 A1 * 9/2003 Sato et al. ..... 399/302

FOREIGN PATENT DOCUMENTS

JP 02-157769 * 6/1990
JP 09-114266 * 5/1997
JP 09-169445 * 6/1997
JP 10-254252 * 9/1998
JP 2000-075579 * 3/2000

* cited by examiner

*Primary Examiner*—Sophia S. Chen
(74) *Attorney, Agent, or Firm*—Fitzpatrick, Cella, Harper & Scinto

(57) ABSTRACT

An image forming apparatus includes an image bearing member; a movable belt, wherein an image on the image bearing member is transferred toward the belt; a supporting member for supporting the belt, wherein the belt has a first engaging portion, and the supporting member has a second engaging portion, and the belt is regulated in a lateral shifting by engagement between the first engaging portion and the second engaging portion; a regulating member, disposed out of contact with the belt, for regulating movement of the first engaging portion, wherein when the belt moves, the regulating member is effective to prevent the first engaging portion from disengaging from the second engaging portion.

23 Claims, 7 Drawing Sheets

IMAGE FORMING APPARATUS AND BELT ROTATING DEVICE

FIELD OF THE INVENTION AND RELATED ART

The present invention relates to an image forming apparatus such as a copying machine, a printer, etc. In particular, it relates to an image forming apparatus comprising a belt driving apparatus in which a belt is circularly driven.

In the field of an electrophotographic color image forming apparatus, there have been proposed various methods for obtaining a color image by transferring a plurality of images, different in color, formed of developers different in color, onto the same piece of recording medium. According to one of such methods, in order to form a color image, a sequence comprising: a step of forming a latent image on a photoconductive drum as an image bearing member; a step of developing the latent image on the photoconductive drum by a developing device, into an image formed of developer; and a step of transferring the developer image, or the image formed of developer, onto a piece of transfer medium held on a transfer belt, is carried out for each of the color components of the intended image. According to another of such methods, instead of transferring the developer images one by one from the photoconductive drum onto a piece of transfer medium, the developer images are temporarily placed in layers on an intermediary transfer medium in the form of a belt, a piece of film, or the like, without being directly transferred onto the intermediary transfer medium, and then, they are transferred all at once from the intermediary transfer medium onto a piece of transfer medium.

An apparatus which employs an endless belt as a transfer medium conveyance belt or an intermediary transfer member inevitably suffers from the problem that as the belt stretched around a plurality of rollers is circularly driven, such force that pressures the belt in the direction perpendicular to the axial direction of the rollers is generated, causing the belt to snake or laterally deviate.

Thus, it has been common practice to employ the combination of a belt, the inwardly facing surface of which is provided with ribs (projections) for preventing the lateral deviation of the belt, and a flange provided with grooves for accommodating the ribs of the belt, in order to prevent the lateral belt deviation.

The above described structural arrangement, however, suffers, from the following problem. That is, if the force which pressures the endless belt in the direction perpendicular to the axial direction of the flange is constant in direction, and substantial, the flange fails to prevent the endless belt from being laterally deviated. More specifically, as the rib portion of a given point of the endless belt, in terms of the rotational direction, meets the groove of the flange, the rib portion of the belt is forced to run onto the belt bearing surface of the flange, that is, the portion of the flange, which is one step higher than the bottom of the groove. Thus, as the flange (belt) is rotated, the rib portion of the belt starts running on the belt bearing surface of the flange, causing the belt to float from the belt bearing surface of the flange. As the rib portion of the belt runs onto the belt bearing surface of the flange, it is locally overstretched. As a result, the belt itself becomes damaged; for example, the belt develops cracks. Further, in the case of an image forming apparatus employing a belt as an intermediary transfer member, an image is formed on the wrong area of a transfer medium.

An image forming apparatus employing a belt as an intermediary transfer member also suffers from the problem that a piece of transfer medium (recording paper), onto which an image is transferred, sometimes remains wrapped around a belt used as the intermediary transfer member, and enters a belt driving apparatus.

SUMMARY OF THE INVENTION

The primary object of the present invention is to provide a belt driving apparatus the belt of which does not float, being therefore stable in movement, and also to provide an image forming apparatus employing such a belt driving apparatus.

Another object of the present invention is to provide an image forming apparatus comprising: an image bearing member; a circularly drivable belt, onto which an image on the image bearing member is transferred, and which has a first regulatory portion (protruding portion); a supporting member for supporting the belt, which has a second regulatory portion (recessed portion); and a regulatory member for regulating the lateral deviation of the first regulatory portion (protruding portion), wherein, the first regulatory portion (protruding portion) fits in the second regulatory portion, regulating the lateral deviation of the belt, and wherein when the belt is in circular motion, the regulatory member prevents the first regulatory portion (protruding portion) from coming out of the second regulatory portion (recessed portion).

Another object of the present invention is to provide a belt driving apparatus comprising: a circularly drivable belt having a first regulatory portion (protruding portion); a supporting member for supporting the belt, which has a second regulatory portion (recessed portion); and a regulating member disposed in noncontact with the belt in order to regulate the lateral deviation of the first regulatory portion (protruding portion), wherein the first regulatory portion (protruding portion) fits in the second regulatory portion (recessed portion), regulating the lateral deviation of the belt, and wherein when the belt is in circular motion, the regulatory member prevents the first regulatory portion (protruding portion) from coming out of the second regulatory portion (recessed portion).

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the appended drawings. The measurements, materials, and shapes of the structural components of the image forming apparatus, their positional relationship, etc., in the following embodiments of the present invention, are to be modified according to the structure of an image forming apparatus to which the present invention is applied, and the various conditions under which the present invention is applied. In other words, the scope of the present invention is not to be limited by the following embodiments of the present invention, unless specifically noted.

Embodiment 1

Next, the image forming apparatus in the first embodiment of the present invention will be described with reference to the appended drawings.

Figure 1:
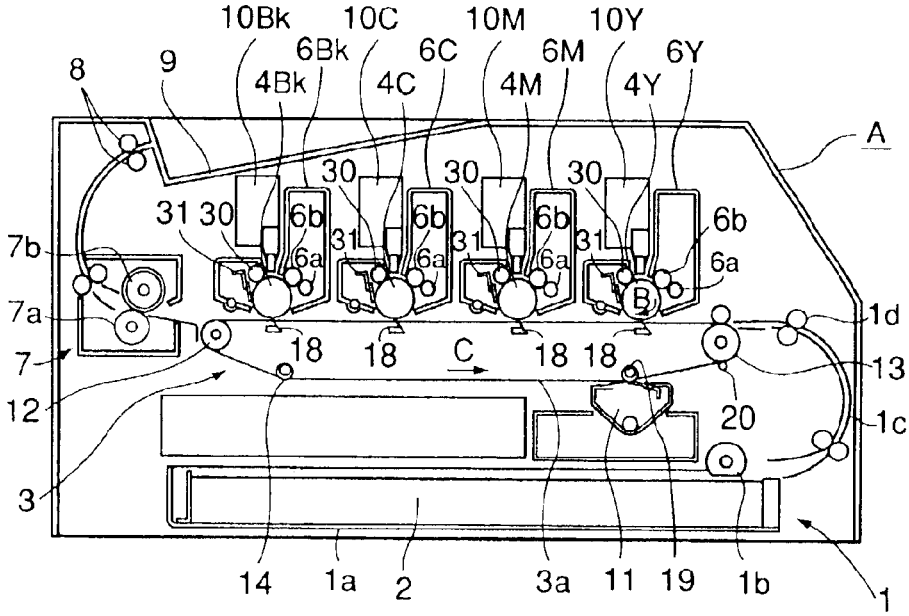
FIG. 1 is a vertical sectional view of the image forming apparatus in one of the preferred embodiments of the present invention, showing the general structure thereof.
Figure 2:
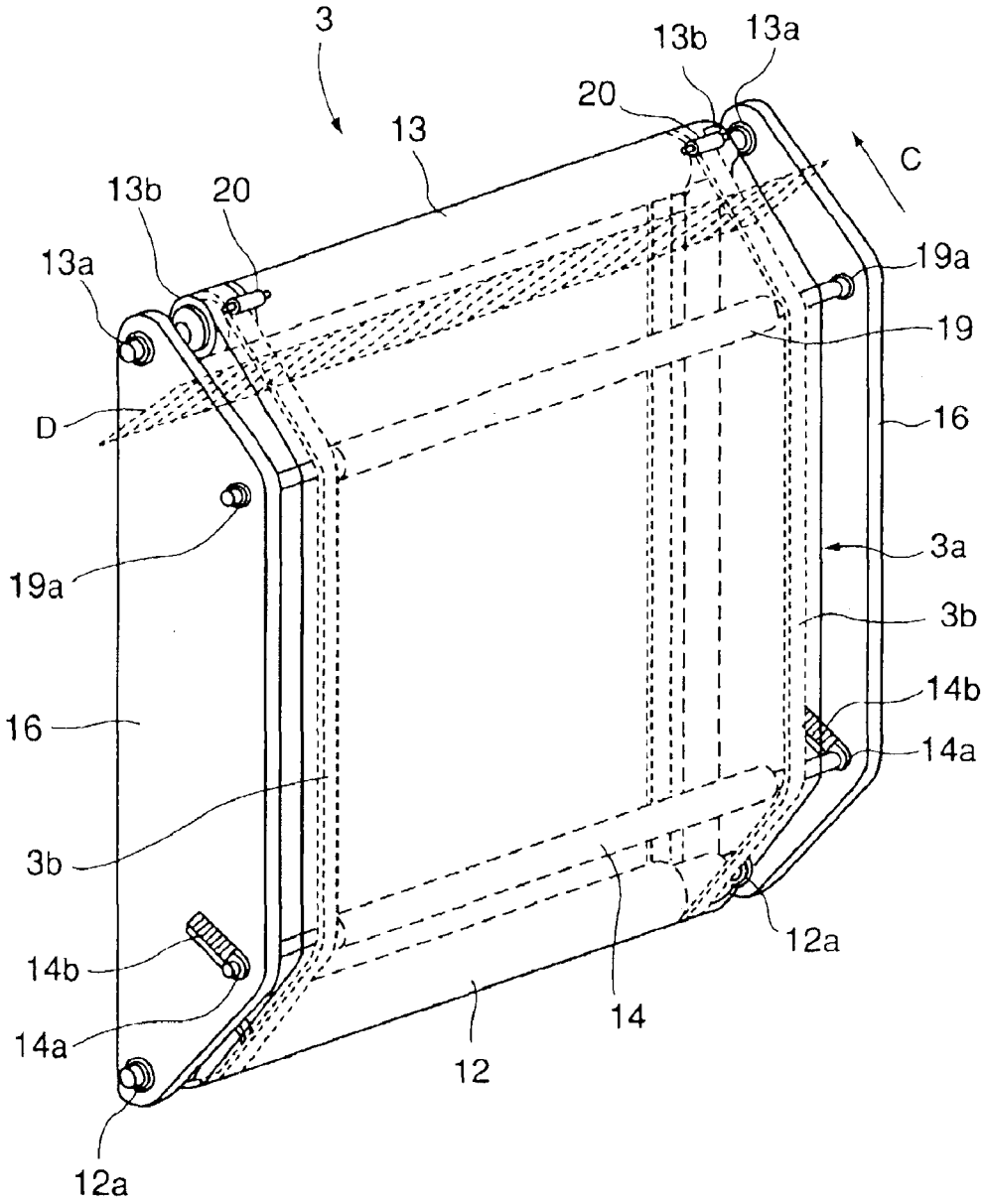
FIG. 2 is a perspective view of the belt driving apparatus.
Figure 3:
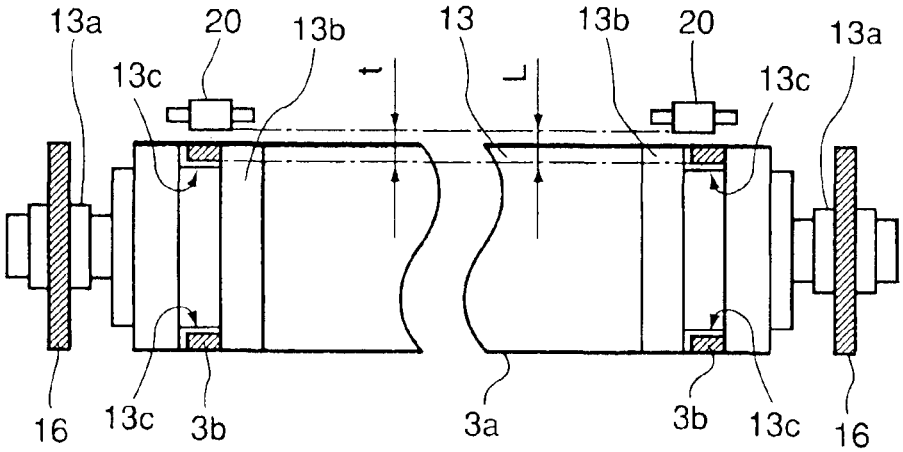
FIG. 3 is a sectional view of the belt driving apparatus in FIG. 2, at a plane D in FIG. 2.
Figure 4:
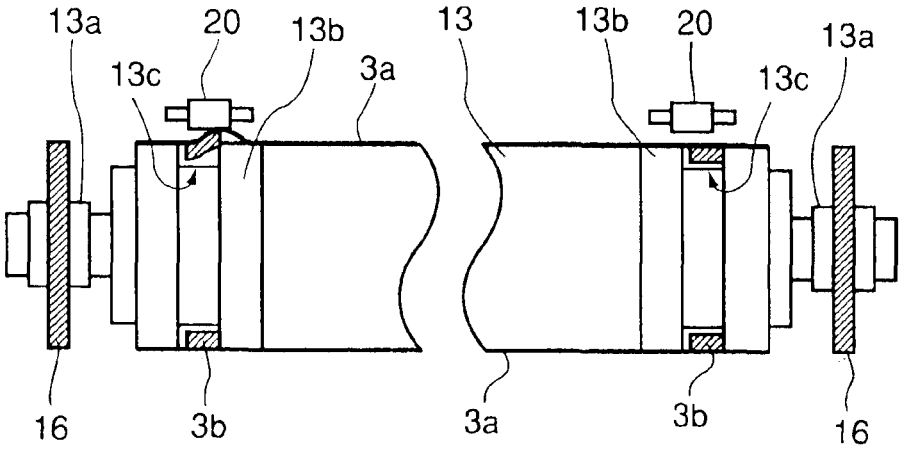
FIG. 4 is a sectional view of the belt driving apparatus, showing how the rib of the belt is prevented from causing the belt to float.

FIG. 1 is a vertical sectional view of the image forming apparatus in the first embodiment of the present invention, showing the general structure thereof, and FIG. 2 is a perspective view of the belt driving apparatus 3 of the image forming apparatus in FIG. 1. FIGS. 3 and 4 are sectional views of the belt driving apparatus 1 in FIG. 2, at a plane D in FIG. 2. First, the image forming apparatus in this embodiment will be described with reference to a laser beam printer.

The image forming apparatus shown in FIG. 1 has four image formation units which comprise four developing devices 6 (6Y, 6M, 6C, and 6Bk) and four image bearing members 4(4Y, 4M, 4C, and 4Bk), one for one. Designated by a referential numeral 3 is a belt driving apparatus for conveying a transfer medium 2, that is, a piece of recording medium, delivered from the sheet feeding portion 1. While the transfer medium 2 is conveyed by the belt of the belt driving apparatus, it remains adhered to the belt. As the transfer medium 2 is conveyed by the belt of the belt driving apparatus 3, a plurality of toner images are sequentially transferred onto the transfer medium 2. Then, after the transfer of all the toner images onto the recording medium 2, the transfer medium 2 is passed through the fixing means 7. While the recording medium 2 is passed through the fixing means 7, the toner images on the transfer medium 2 are fixed to the transfer medium 2. Then, the transfer medium 2 is discharged by the pair of discharge rollers 8 into the delivery tray 9 located on top of the image forming apparatus. Next, each of the operational potions of the image forming apparatus, by which the above described image formation steps are carried out, will be described in the appropriate order.

Each of the aforementioned image formation units comprises an image bearing member 4, a developing device 6, a primary charging means 30, and a cleaner 31, which are integrally disposed in an external shell, forming an image formation unit. In the image formation unit, the primary charging means 30 and cleaner 31 are disposed next to, or in contact with, the peripheral surface of the image bearing member 4. Each image formation unit is easily replaceable from the top side of the main assembly A of the image forming apparatus, making it possible to replace the image forming unit according to the length of its service life, the amount of the toner remaining therein, or the amount of the waste toner therein.

The primary charging means 30 in this embodiment is one of those which employ the so-called contact type charging method. Its electrically conductive roller is placed in contact with the image bearing member 4. As voltage is applied to the electrically conductive roller, the peripheral surface of the image bearing member 4 is uniformly charged.

The beam of light for exposing the image bearing member 4 is projected from a scanner portion 10 (10Y, 10M, 10C, and 10Bk). More specifically, as image formation signals are given to an unshown laser diode, the laser diode emits a beam of light modulated by the image formation signals, toward a polygon mirror, which is being rotated at a high speed by a scanner motor. The beam of light reflected by the polygon mirror is focused on the peripheral surface of the image bearing member 4 by the combination of a focusing lens and a deflection mirror. As a result, numerous points on the peripheral surface of the image bearing member 4 are selectively exposed.

In the developing device 6, toner is sent by a toner sending mechanism to a coating roller 6*a*, which is located so that its peripheral surface is positioned virtually in contact with the peripheral surface of the development sleeve 6*b* of the developing device 6, and which is being rotated. As a result, the toner is coated in a thin layer on the peripheral surface of the development sleeve 6*b*, while being electrically charged (by friction). As development bias is applied between the development sleeve 6*b*, and the image bearing member 4, which is bearing a latent image, the toner is adhered to the peripheral surface of the image bearing member 4 in the pattern of the latent image; in other words, the latent image is developed.

The main assembly A of the image forming apparatus is provided with a plurality of high voltage power sources for development, which are connected to the development sleeves 6*b* of the developing devices 6, one for one, so that development voltage can be selectively charged to the development sleeves 6*b*.

The sheet feeding portion 1 is the portion from which the transfer medium 2 is delivered to the belt driving apparatus 3. It comprises a sheet feeding cassette 1*a* which holds a plurality of transfer mediums 2, and which is placed in the bottom portion of the apparatus main assembly A. During an image forming operation, the feed roller 1*b* is rotationally driven in response to the specific step of the image forming operation, feeding a plurality of (or a single) transfer mediums 2 into the apparatus main assembly A, one by one, while separating them. After being fed into the apparatus main assembly A, each transfer medium 2 is conveyed between a pair of registration rollers 1*d*, and is further conveyed, while being guided by a guiding plate 1*c*, to the belt driving apparatus 3.

The belt driving apparatus 3 adheres, to its surface, each transfer medium 2 delivered from the sheet feeding portion 1, and conveys the transfer medium 2 to each of the transferring stations different in the color in which a latent image is developed. While the transfer medium 2 is conveyed by the belt driving apparatus 3, the developer image on each image bearing member 4 is transferred onto the belt 3*a*. More specifically, the developer images formed on the four image bearing members 4, one for one, are sequentially transferred by the transferring means 18 onto the transfer medium 2 borne on the belt 3*a*, in such a manner that the developer images are placed in layers on the transfer medium 2. Designated by a referential numeral 11 is a cleaning means for cleaning the belt 3*a*.

The belt driving apparatus 3 in this embodiment comprises: an endless belt 3*a* formed of a resin (electrostatic conveyance belt); four rollers (drive roller 12, adhesion roller 13, tension roller 14, and pinch roller 19 for keeping belt 3*a* in contact with cleaning means) around which the belt 3*a* is stretched; etc. Each of these four rollers also functions as a member for supporting the belt 3*a*.

The fixing means 7 is a means for permanently adhering the images on the transfer medium 2, to the transfer medium 2. Referring to FIG. 1, the fixing means 7 comprises: a driver roller 7*a* which is rotationally driven; and a fixer roller 7*b* which is kept pressed upon the driver roller 7*a* to apply heat and pressure to the transfer medium 2. More specifically, after the sequential transfer of the toner images on the image bearing members 4 onto the transfer medium 2, the transfer medium 2 is conveyed to the fixing means 7 and conveyed through the fixing means 7 by the driver roller 7*a*. While the transfer medium 2 is conveyed through the fixing means 7 by the driver roller 7*a*, heat and pressure is applied to the combination of the transfer medium 2 and the toner images thereon. As a result, the toner images are fixed to the transfer medium 2.

The cleaner 31 is a device for removing the toner remaining on the image bearing member 4 after the transfer of the toner image (developer image), that is, the visible image, formed on the image bearing member 4 through the development process carried out by the developing device 6. The cleaner 31 in this embodiment is in the form of a blade, and is disposed in contact with the peripheral surface of the image bearing member 4, being tilted so that its cleaning edge is aimed upstream in terms of the moving direction of the peripheral surface of the image bearing member 4.

Next, the image forming operation of the image forming apparatus structured as described above will be described.

The image bearing member 4 is rotated in the direction indicated by an arrow mark B in FIG. 1 in synchronism with the rotation of the belt 3*a*. As the image bearing member 4 is rotated, the peripheral surface of the image bearing member 4 is uniformly charged by the primary charging means 30, and the charged portion of the peripheral surface of the image bearing member 4 is exposed to a beam of light projected from the scanner portion 10 (10Y, 10M, 10C, or 10Bk) in accordance with the image formation data corresponding to one of the color components of an intended image. As a result, a latent image corresponding to one of the color components of the intended image is formed on the peripheral surface of the image bearing member 4. In synchronism with the formation of the latent image, such voltage that is the same in polarity, and is virtually the same in potential level, as the electrical charge on the image bearing member 4, is applied to the development sleeve 6*a* to develop the latent image, that is, to adhere the toner to the peripheral surface of the image bearing member 4 in the pattern of the latent image. As a result, a visible image is formed of toner, on the peripheral surface of the image bearing member 4. The image formed of toner, or the toner image, is transferred by the transferring means 18 onto the transfer medium 2, which has been fed by the sheet feeding portion 1 into the apparatus main assembly A and is being conveyed by the electrostatic conveyance belt 3*a* through the transfer station. The above described image formation sequence is carried out by all the image bearing members 4. Consequently, a plurality of toner images different in color are sequentially placed in layers on the transfer medium 2.

After the placement of the toner images on the transfer medium 2, the transfer medium 2 is conveyed to the fixing means 7, by which the toner images are fixed to the transfer medium 2. After the fixation of the toner images, the transfer medium 2 is discharged into the delivery tray 9 by the pair of discharge rollers 8, ending the image formation operation.

Next, referring to FIG. 2, the belt driving apparatus in this embodiment will be described.

The rollers 12, 13, 14, and 19 are rotatably supported by bearings 12*a*, 13*a*, 14*a*, and 19*a*, respectively, attached to the side plates 16, as shown in FIG. 2. As the driver roller 12 is rotated in response to a predetermined point in the image formation sequence, the belt 3*a* is moved in the direction indicated by an arrow mark C in the drawing. The bearings 12*a* for the driver roller 12, the bearings 13*a* for the adhesion roller 13, and the bearings 19*a* for the pinch roller 19, are solidly attached to the side plates 16, being precisely positioned relative to the side plates 16, whereas the bearings 14*a* for the tension roller 14 are attached to the side plates so that they can be slid in the direction perpendicular to the axial direction of the tension roller 14. Further, the tension roller bearings 14*a* are kept under the pressure from a pair of tension springs 14*b* as a pressure applying means, causing the tension roller 14 supported by the bearings 14*a* to tension the belt 3*a*.

The belt 3*a* is provided with a pair of ribs 3*b*, as first (male) regulatory portions, for preventing the belt 3*a* from being deviated in the direction perpendicular to the moving direction of the belt 3*a*. The ribs 3*b* are disposed on the inward surface of the belt 3*a*, along the lateral edges thereof, one on one. On the other hand, the adhesion roller 13 is provided with a pair of grooves 13*c*, as second (female) regulatory potions, in which the pair of ribs 3*b* of the belt 3*a* are to fit. The grooves 13*c* are located at the lengthwise ends of the adhesion roller 13, extending circumferentially along the edges, one for one. Thus, it is expected that as the ribs 3*b* fit in the grooves 13*c*, one for one, the belt 3*a* is prevented from being deviated in the axial direction of the rollers. The first portion is a protruding portion, and second portion is a recessed portion.

Theoretically, a belt, in particular, a belt formed of a resin, stretched around a plurality of shafts does not deviate in the axial direction of the shafts unless it is subjected to some type of force which acts in the axial direction. In reality, however, such a belt is likely to be deviated in the axial direction of the rollers because nonuniformity in the distance between adjacent two belt supporting rollers, a difference in circumference between the left and right edges of the belt, nonuniformity in the thickness of the belt, and the like factors are likely to result in the generation of such force that pressures the belt 3*a* in the axial direction of the rollers. Thus, in the case of the above described structural arrangement in which the lateral movement of the belt is regulated by the provision o the combination of the ribs on the belt side, and the grooves on the flange side, each rib is pushed against the unspecific (left or right) wall of the corresponding groove of the flange by the above described lateral force. Further, in some cases, the lateral force is large enough to cause the ribs to move out of the grooves and run onto the belt bearing surface of the flange.

Thus, in this embodiment, the belt driving apparatus 3 is provided with a pair of rollers 20, that is, rotational members, for preventing the belt 3*a* from locally bulging (floating). The pair of rollers 20 are located near the pair of grooved flanges 13*b* of the adhesion roller 13, one for one, on the upstream side, that is, where the pair of ribs 3*b* fit into the pair of grooves 13*c*, one for one, in other words, the upstream side of the area where a given point of the belt 3*a* comes into contact with the adhesion roller 13 as the belt 3*a* is circularly driven. Each roller 20 is in the adjacencies of the corresponding rib 3*b* of the belt 3*a*. The shaft of each roller 20 is roughly in parallel with the shaft of the roller 13. Each roller 20 is rotatably supported by the unshown frame. Referring to FIG. 3, the distance L from the peripheral surface of the belt 3*a* to the peripheral surface of the roller 20 is no more than the thickness (height) t of the rib 3*b*. Therefore, when the belt 3*a* is not in motion, the roller 20 is not in contact with the belt 3*a*, remaining aligned with the rib 3*b* in terms of the radius direction of the adhesion roller 13, with the interposition of the belt 3*a*. On the other hand, when the belt 3*a* is in motion, the roller 20 prevents rib 3*b* from coming out of the groove 13*c*. In other words, the roller 20 is a regulating member for regulating the deviation of the belt 3*a* in the radius direction of the adhesion roller 13.

With the provision of the above described structural arrangement, even if the belt 3*a* is subjected to such force that pressures the belt 3*a* in the direction to cause the rib 3*b* to come out of the groove 13*c* and run on the belt bearing surface of the flange 13*b*, as shown in FIG. 4, the roller 20 prevents the belt 3*a* from bulging further, since the belt 3*a* comes into contact with the roller 20 before it comes out of the groove 13*c*. Therefore, there occurs neither the problem that the rib 3*b* comes out of the groove 13*b*, nor the problem that the belt 3*a* becomes damaged.

Although FIG. 4 shows the case in which the belt 3*a* is subjected to such force that pressures the belt 3*a* to move rightward in the drawing, the effects of this embodiment is the same as those described above, even if the belt 3*a* is subjected to such forced that pressures the belt 3*a* leftward. Further, the belt 3*a* may be provided with only one rib 3*b*; the rib 3*b* may be disposed along only one edge of the belt 3*a*. Such a configuration accomplishes the same effects as those described above.

Embodiment 2

Next, the image forming apparatus in the second embodiment of the present invention will be described with reference to the appended drawings.

Figure 5:
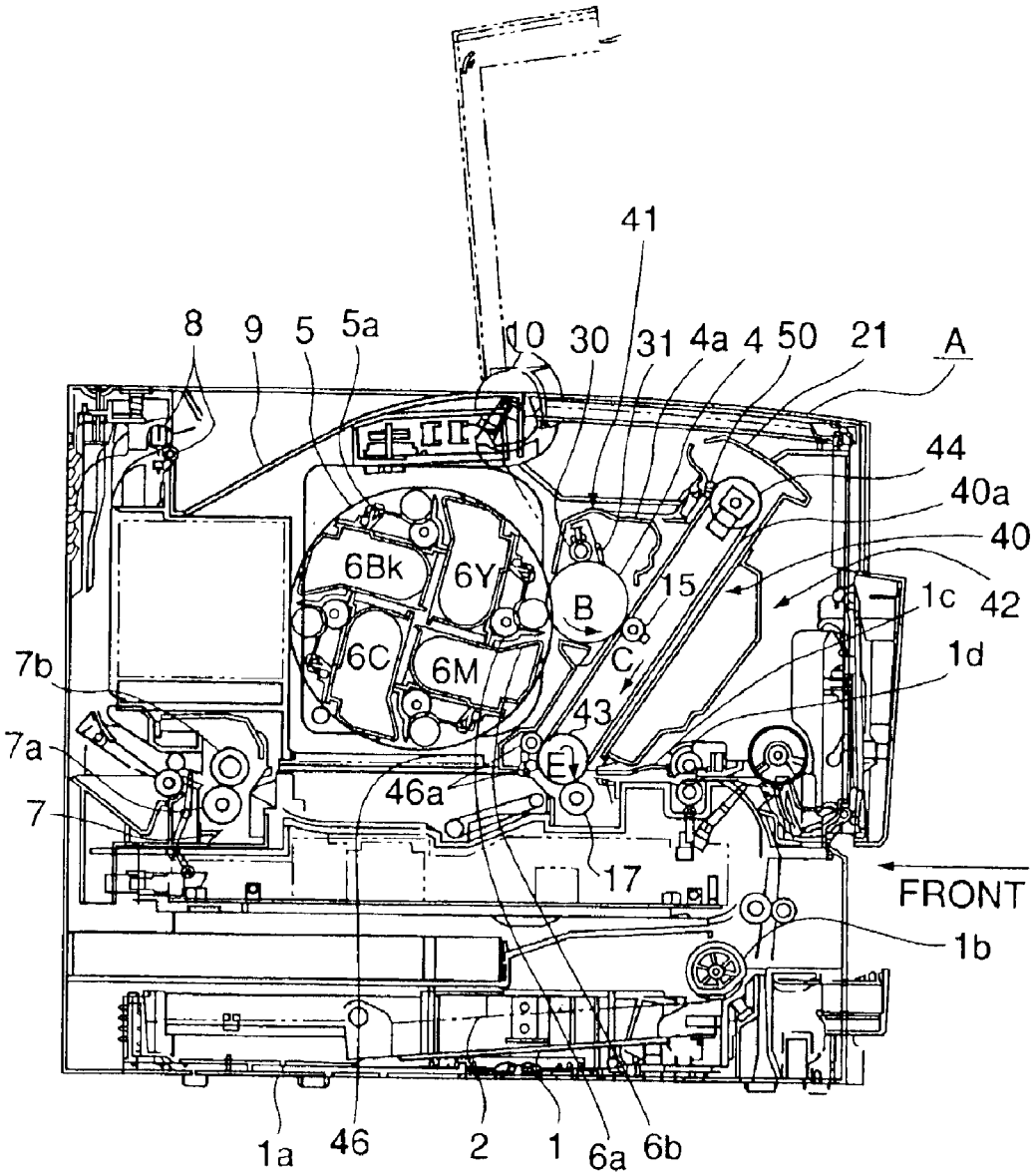
FIG. 5 is a vertical sectional view of the image forming apparatus in another embodiment of the present invention, showing the general structure thereof.
Figure 6:
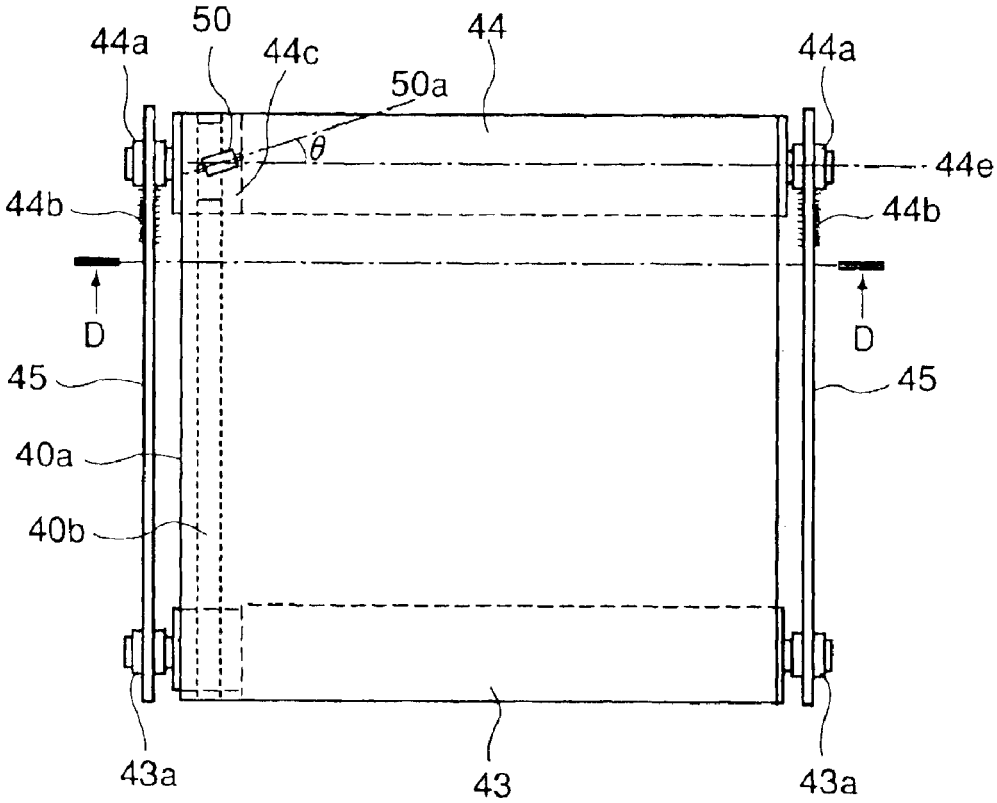
FIG. 6 is a plan view of the belt driving apparatus.
Figure 7:
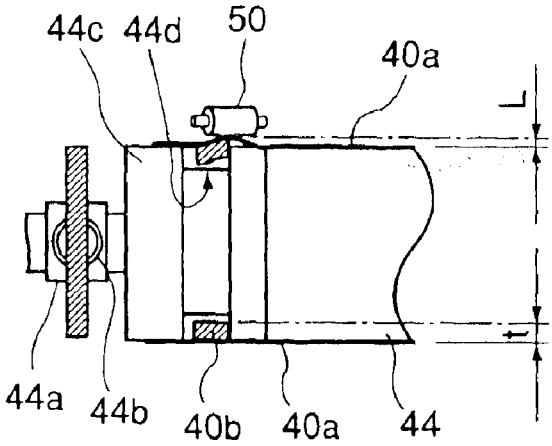
FIG. 7 is a sectional view of the belt driving apparatus in FIG. 6, at a plane D—D in FIG. 6.

FIG. 5 is a vertical sectional view of the image forming apparatus in this embodiment of the present invention, showing the general structure thereof, and FIG. 6 is a top plan view of the belt driving apparatus. FIG. 7 is a sectional view of the belt driving apparatus in FIG. 6, at a plane D—D in FIG. 6. The portions of the image forming apparatus in this embodiment similar in structure to those in the first embodiment will not be described.

The image forming apparatus shown in FIG. 5 has a rotary type development unit 5 in which four developing devices 6 (6Y, 6M, 6C, and 6Bk) are disposed. In operation, a plurality of electrostatic latent images are sequentially formed on the image bearing member 4, and are sequentially developed by the development unit 5. Then, the developed latent images, that is, images formed, one for one, of the developers different in color, are transferred (primary transfer) in layers onto the intermediary transfer member, which is the belt of the intermediary transfer belt unit 40. Then, the layered developer images on the belt of the intermediary transfer belt unit 40 are transferred all at once onto the transfer medium 2 delivered from the sheet feeding portion 1. Then, a permanent color image is formed on the recording medium 2 by applying heat and pressure to the combination of the transfer medium 2 and the developer images thereon with the use of the fixing means 7. Then, the transfer medium 2 is discharged by the pair of discharge rollers 8 into the delivery tray 9 located on top of the image forming apparatus. Next, the portions of the image forming apparatus, which carry out the above described image formation steps, one for one, will be described in the appropriate order.

The sheet feeding portion 1 is the portion from which the transfer medium 2 is delivered to the intermediary transfer member 40*a*. The transfer medium 2 is conveyed between a pair of registration rollers 1*d*, and is further conveyed to the intermediary transfer member 40*a*.

The image bearing member 4 is rotationally supported by a rotational axle attached to an image bearing member unit cover 4*a*. The primary charging means 30 and cleaner 31 are disposed next to, or in contact with, the peripheral surface of the image bearing member 4. As driving force from an unshown motor is transmitted to one end of the rotational axle, the image bearing member 4 is rotated in the direction indicated by an arrow mark B in FIG. 5 in synchronism with the image formation operation.

The image bearing member unit 41 and intermediary transfer member unit 40 are integrated in the form of an image formation unit 42. The waste toner, that is, the toner removed from the peripheral surface of the image bearing member 4 by a cleaner 31 is sent into the waste toner bin of the intermediary transfer member unit 40. The cleaner 31 in this embodiment is a blade disposed in contact with the peripheral surface of the image bearing member 4, being tilted in such a manner that the cleaning edge of the cleaner 31 is aimed upstream in terms of the moving direction of the peripheral surface of the image bearing member 4. The image formation unit 42 is easily replaceable from the top side of the apparatus main assembly A, making it possible to replace the image formation unit 42 according to the length of its service life, or the amount of the waste toner therein.

In order to visualize a latent image, four developing devices 6 (6Y for yellow color component, 6M for magenta color component, 6C for cyan color component, and 6Bk for black color component) are disposed in the development unit 5. During an image formation operation, the development unit 5 is rotated about the shaft 5*a*, and is stopped as the developing device 6, the color of the developer in which matches the color into which the latent image is to be developed, is positioned in a manner to oppose the image bearing member 4. Further, the development unit 5 is structured so that it can be moved to place the development sleeve 6*b* of any developing device 6 in contact with the image bearing member 4.

Further, the development unit 5 is structured so that as the development sleeve 6*b* of any developing device 6 is orbitally moved to the development position, it is connected becomes connected to an unshown high voltage power source of the apparatus main assembly A, so that voltage can be selectively applied to the development sleeve 6*b* which is in the development position. Incidentally, the image forming apparatus is structured so that the orbitally rotatable developing devices can be individually mounted into, or removed from, the apparatus main assembly A from the top side.

Next, the image forming operation of the image forming apparatus structured as described above will be described.

The image bearing member 4 is rotated in the direction indicated by the arrow mark B in FIG. 5 in synchronism with the rotation of the intermediary transfer belt 40*a*. As the image bearing member 4 is rotated, the peripheral surface of the image bearing member 4 is uniformly charged by the primary charging means 30, and the charged portion of the peripheral surface of the image bearing member 4 is exposed to a beam of light projected from the scanner portion 10 in accordance with the image formation data corresponding to the black color component of an intended image. As a result, a latent image corresponding to the black color component of the intended image is formed on the peripheral surface of the image bearing member 4. In synchronism with the formation of the latent image corresponding to the black color component, the developing device 6Bk for developing the latent image corresponding to the black color component is driven to apply to the development sleeve 6*a* such voltage that is the same in polarity, and is virtually the same in potential level, as the electrical charge on the image bearing member 4, in order to develop the latent image, that is, in order to adhere the black toner to the peripheral surface of the image bearing member 4 in the pattern of the latent image on the peripheral surface of the image bearing member 4. As a result, a visible image is formed of toner, on the peripheral surface of the image bearing member 4. The image formed of toner, or the toner image, on the image bearing member 4 is transferred onto the intermediary transfer belt 40*a* by applying to the primary transfer roller 15 such voltage that is opposite in polarity to the toner. In other words, the image on the image bearing member 4 is transferred onto the belt 40*a*.

After the transfer of the black toner image, the next developing device 6 is orbitally moved and stopped at the location at which it opposes the image bearing member 4. Then, it develops the latent image on the peripheral surface of the image bearing member 4 in the same manner as did the developing device 6 for developing the latent image corresponding to the black color component. Then, the developed latent image is transferred onto the intermediary transfer belt 40*a* in a manner to be layered on the black toner image on the intermediary transfer belt 40*a*. This sequence of forming a latent image on the peripheral surface of the image bearing member 4, developing it, and transferring the developed image onto the intermediary transfer belt 40*a* is repeated for the rest of the color components of the intended image. As a result, four color images (yellow, magenta, cyan, and black toner images) are deposited in layers on the intermediary transfer belt 40*a*. Next, the four color toner images on the intermediary transfer belt 40*a* are transferred all at once by the secondary transferring means 17 onto the transfer medium 2 delivered from the sheet feeding portion 1.

After the transfer of the color toner images onto the transfer medium 2, the transfer medium 2 is conveyed to the fixing means 7, in which the toner images are fixed. Thereafter, the transfer medium 2 is discharged by the pair of discharge rollers 8 into the delivery tray 9, ending the image formation operation.

Next, referring to FIG. 6, the intermediary transfer unit, which is a belt driving apparatus, will be described.

The intermediary transfer member 40*a* of the intermediary transfer unit 40, which is a belt driving apparatus, is a medium onto which developer images corresponding one for one in color to the color components of the intended image are temporarily transferred in layers, and from which the developer images are transferred all at once onto the transfer medium 2. In this embodiment, the intermediary transfer member 40*a* is an endless belt formed of a resin, and is stretched between two rollers: a driver roller 43, which doubles as a secondary transfer roller, and a tension roller 44 which is rotated by the rotation of the driver roller 43. In other words, the two rollers 43 and 44 are members for supporting the belt 40*a*.

Referring to FIG. 6, the rollers 43 and 44 are rotationally supported by a pair of bearings 43*a* and 44*a* attached to the side plates 45, one for one. As the driver roller 43 is rotated in response to the image formation operation, the belt 40*a* is rotationally moved in the direction indicated by an arrow mark C in FIG. 5. The bearings 43*a* for the driving roller 43 are solidly attached to the side plates 45, one for one, being precisely positioned relative to the side plates 45, whereas the bearings 44*a* for the tension roller 44 are attached to the side plate 45 so that they can be slid in the direction intersectional to the axial direction of the roller 44. Further, the bearings 44*a* are under the pressure generated by a pair of tension springs 44*b*, one for one, in the direction to increase the distance between each bearing 43*a* and the corresponding bearing 44*a*, tensioning thereby the belt 40*a*. The distance between the rotational shaft of the driver roller 43 and the rotational shaft of the tension roller 44 is made to be roughly equal to the product of the circumference of the image bearing member 4 and a given integer.

The intermediary transfer belt 40*a* is provided with a rib 40*b*, as a first regulatory potion (protruding portion), for regulating the deviation of the intermediary transfer belt 40*a* in the direction perpendicular to the direction in which the intermediary transfer belt 40*a* is circularly driven. The rib 40*b* is disposed on the inward surface of the intermediary transfer belt 40*a*, circumferentially along one edge thereof. Further, the follower roller 44 is provided with a flange 44*c*, which has a groove 44*d*, as a second regulatory portion (recessed portion), in which the rib 40*b* of the intermediary transfer belt 40*a* is to fit to regulate the lateral deviation of the belt 40*a* (movement in the axial direction of roller 44). The groove 44*d* is positioned so that it parallels the edge of the intermediary transfer belt 40*a*. Thus, it is expected that as the rib 40*b* fits in the groove 44*d*, the belt 40*a* is prevented from being deviated in the axial direction of the rollers. The first portion is a protruding portion, and second portion is a recessed portion.

Theoretically, as described before, a belt, in particular, a belt formed of a resin, stretched around a plurality of shafts does not deviate in the axial direction of the shafts unless it is subjected to some type of force which pressures the belt in the axial direction of the rollers. In reality, however, such a belt is likely to be deviated in the axial direction of the rollers because nonuniformity in the distance between adjacent two belt supporting rollers, difference in circumference between the left and right edges of the belt, nonuniformity in the thickness of the belt, and the like factors are likely to generate such force that pressures the belt in the axial direction of the rollers. Thus, in the case of the above described structural arrangement in which the lateral deviation of the belt is regulated by the provision of the combination of the rib on the belt side, and the groove on the flange side, the rib is pushed against the unspecific (left or right) wall of the groove of the flange by the above described lateral force.

In this embodiment, only one rib 40*b* is positioned along only one edge of the belt, and such a structural arrangement is made that the force which is generated by the above described anomalies of the belt and the distance between the driver roller and follower roller, etc., pressures the belt only toward the center of the driver roller.

Therefore, if the lateral force is substantial, the rib 40*b* is forced out of the groove toward the center of the driver roller, ending up running on the belt bearing surface of the driver roller.

Thus, in this embodiment, the belt driving apparatus is provided with a roller 50, that is, a rotational member, for preventing the belt 40*a* from locally bulging (floating). The roller 50 is located near the grooved flange 44*c* of the roller 44, on the upstream side, that is, where a given point of the rib 40*b* fits into the grooves 44*d* as the belt 40*a* is circularly driven, that is, the upstream side of the area where the belt 40*a* comes into contact with the roller 44. The roller 50 is in the adjacencies of the peripheral surface of the belt 40*a*, and also, in the adjacencies of the rib 40*b* of the belt 40*a*. The shaft 50*a* of the roller 50 is tilted at an angle of θ relative to the shaft 44*e* of the roller 44 (direction perpendicular to the circular movement of the belt); the angle of the roller 50 is such that the roller 50 pressures the edge portion of the belt 40*a* outward in terms of the width direction of the belt 40*a*.

Referring to FIG. 7, the roller 50 is rotationally supported by the external frame of the intermediary transfer member unit 40. The distance L from the peripheral surface of the belt 40*a* to the peripheral surface of the roller 50 is no more than the thickness (height) t of the rib 40*b*.

More specifically, the roller 50 is a regulating member, and is disposed so that when the belt 40*a* is not in motion, the roller 50 does not contact the belt 40*a*, while remaining in alignment with the rib 40*b* in terms of the radius direction of the roller 44, with the belt 40*a* interposed, in order to regulate the deviation of the belt 40*a* in the direction to float from the peripheral surface of the roller 44. Thus, when the belt 40*a* is in motion, the roller 50 prevents rib 40*b* from coming out of the groove 44*d*.

With the provision of the above described arrangement, even if such force that pressures the belt 40*a* sideways, that is, even if the belt 40*a* is pressured in the direction to force the rib 40*b* to come out from the groove 44*d* and run onto the belt bearing surface of the flange 44*c*, the peripheral surface of the belt 40*a* comes into contact with the roller 50. Therefore, the belt 40*a* is prevented from coming out of the groove 44*d* and running onto the belt bearing surface of the flange 44*c*. In other words, the above described structural arrangement stabilized the movement of the belt 40*a*.

Further, in this embodiment, the roller 50 is tilted outward with reference to the direction in which the belt 40*a* is rotationally driven. Therefore, while the belt 40*a* is in contact with the roller 50, the roller 50 pressures the belt 40*a* outward of the belt 40*a* in terms of the width direction of the belt 40, further assuring that the rib 40*b* is prevented from coming out of the groove 44*d*, and also, that the belt 40*a* is prevented from being damaged.

Figure 8:
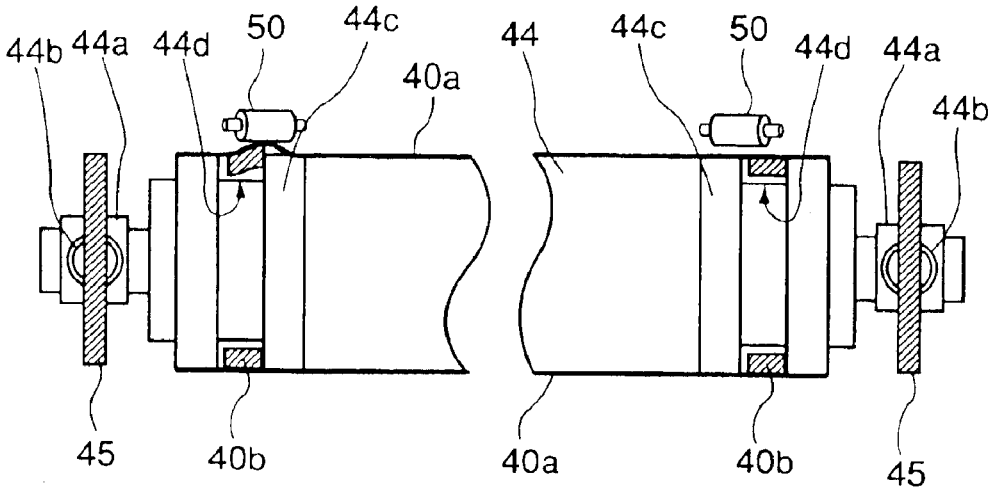
FIG. 8 is a sectional view of one of the modified versions of the belt driving apparatus shown in FIG. 6.
Figure 9:
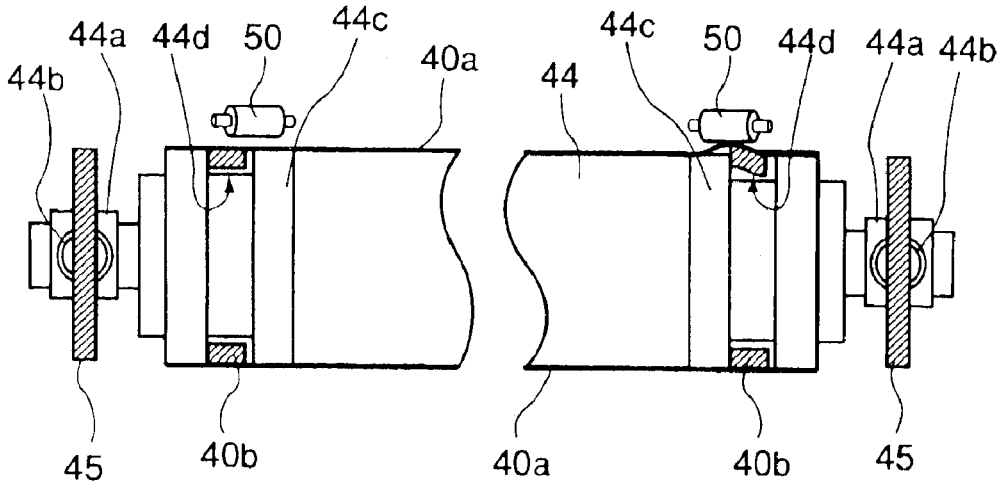
FIG. 9 is a sectional view of another modified version of the belt driving apparatus shown in FIG. 6.
Figure 10:
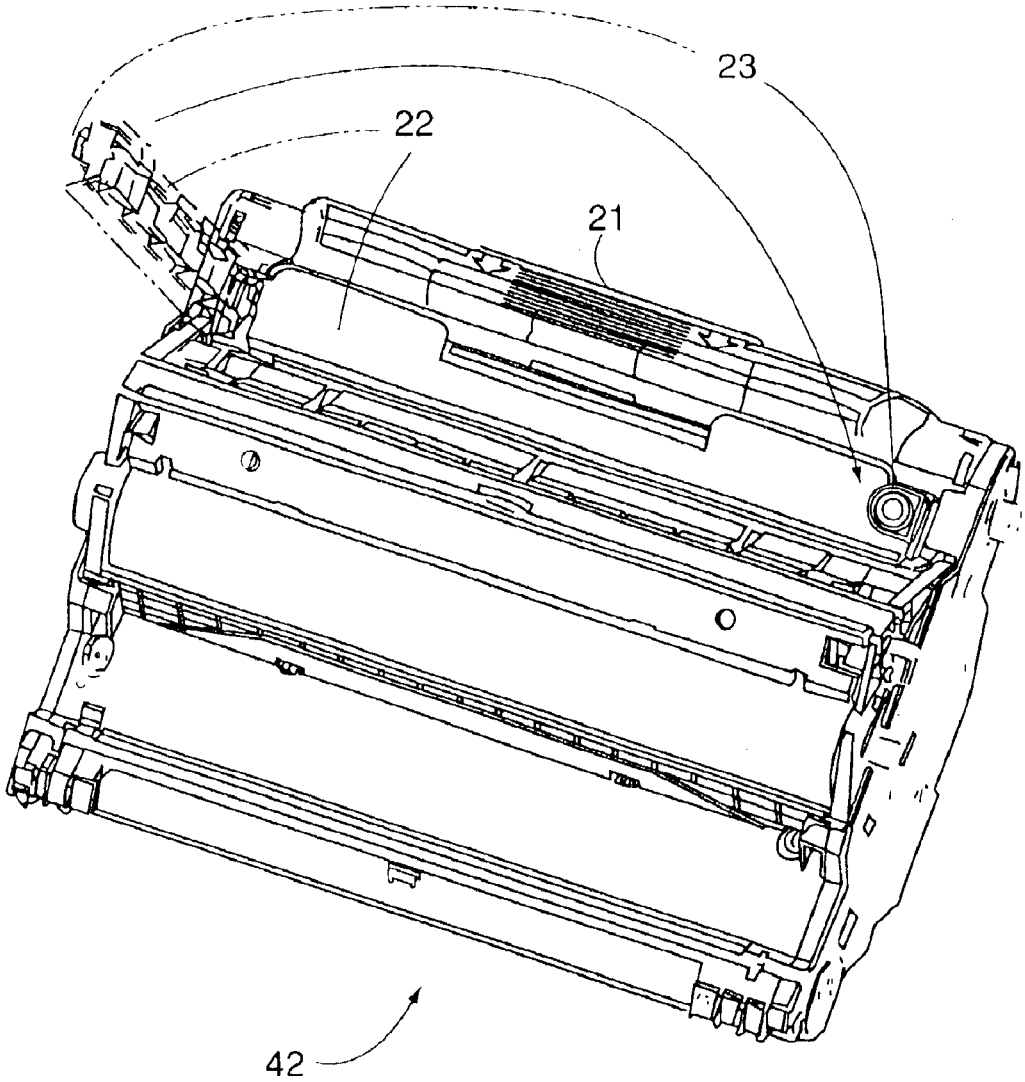
FIG. 10 is a perspective view of the image formation unit of one of the image forming apparatuses in accordance with the present invention.

In this embodiment, the belt 40*a* is provided with only one rib 40*b*, which is positioned along one edge of the belt 40*a* in terms of the width direction of the belt 40*a*. However, the belt 40*a* may be provided with two ribs 40*b*, which are positioned along both edges of the belt 40*a*, one for one, as shown in FIGS. 8 and 9. In such a case, the angled placement of the roller 50 is effective to prevent the lateral deviation of the belt 40*a*, regardless of the direction of the lateral belt deviation.

Further, there is provided a cleaning unit 46, which is at a predetermined location in the adjacencies of the peripheral surface of the intermediary transfer belt 40*a*. The cleaning unit 46 removes the residual toner, that is, the toner remaining on the belt 40*a* after the toner images on the belt 40*a* are transferred all at once onto the transfer medium 2. The cleaning unit 46 has a charge roller 46*a* which can be placed in contact with, or moved away from, the belt 40*a*. In order to clean the intermediary transfer belt 40*a*, voltage which is opposite in polarity to the voltage applied for transfer is applied to the residual toner on the intermediary transfer belt 40*a*. With the application of the voltage, the residual toner on the intermediary transfer belt 40*a* is electrostatically transferred onto the image bearing member 4, and then, is recovered by the cleaner 31 for the image bearing member 4.

The choice of the method for cleaning the intermediary transfer belt 40*a* does not need to be limited to the above described electrostatic cleaning method. For example, a mechanical method employing a blade, a fur brush, or the like, may be employed. Further, various cleaning methods may be employed in combination.

In the secondary transfer station E, the curvature of the driver roller 43 is utilized to separate the transfer medium 2 from the intermediary transfer belt 40*a*. Thus, on rare occasion, the transfer medium 2 fails to separate from the intermediary transfer belt 40*a*, that is, remains wrapped around the belt 40*a*, and enters the intermediary transfer unit 40. Once the transfer medium 2 enters the intermediary transfer unit 40, it is very difficult to remove the transfer medium 2, because only place at which the peripheral surface of the belt 40*a* is exposed is the secondary transfer station E of the intermediary transfer unit 40.

Thus, in this embodiment, the external shell of the image formation unit 42 is provided with a jam clearance door 22, that is, a door for dealing with a jam. The jam clearance door 22 is located near the handle 21 for mounting or dismounting the image formation unit 42, and faces the peripheral surface of the intermediary transfer unit 40, on which the transfer medium 2 is conveyed.

The jam clearance door 22 is hinged to the external shell of the image formation unit 42, near the handle 21, and is kept shut with the use of a screw which can be manually tightened or loosened.

With the provision of the above described structural arrangement, the transfer medium 2 having remained wrapped around the belt 40*a* and entered the intermediary transfer unit 40 can be removed simply opening the jam clearance door 22, without the need for removing the image formation unit 42 from the apparatus main assembly A.

As described above, according to the present invention, it is possible to prevent the problem that while a belt is circularly driven, the ribs of the belt run onto the belt bearing surface of the grooved flange. Therefore, it is possible to prevent the problem that as the ribs of the intermediary transfer belt of an image forming apparatus run onto the belt bearing surface of the grooved flange, images of inferior quality are produced, or the problem that the belt is damaged.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

an image bearing member;

a movable belt, wherein an image on said image bearing member is transferred toward said belt;

a supporting member for supporting said belt, wherein said belt includes a first engaging portion, and said supporting member includes a second engaging portion, and said belt is regulated from laterally shifting by engaging said first engaging portion and said second engaging portion; and a regulating member, disposed out of contact with said belt, for regulating movement of said first engaging portion, wherein said regulating member is disposed so as to be opposed to said first engaging portion with said belt interposed therebetween, and wherein when said belt moves, said regulating member is effective to prevent said first engaging portion from disengaging from said second engaging portion.

2. An apparatus according to claim 1, wherein said regulating member is disposed upstream of a region where said belt is contacted to said supporting member with respect to a movement direction of said belt.

3. An apparatus according to claim 1, wherein said regulating member is a rotatable member.

4. An apparatus according to claim 3, wherein a rotational axis of said regulating member is inclined with respect to a direction perpendicular to a movement direction of said belt.

5. An apparatus according to claim 4, wherein said regulating member is inclined in a direction of urging an end portion of said belt outwardly.

6. An apparatus according to claim 1, wherein a distance from a surface of said belt to said regulating member is smaller than a length of said first engaging portion.

7. An apparatus according to claim 1, wherein said first engaging portion includes a projected portion, and said second engaging portion includes a recessed portion.

8. An apparatus according to claim 1, wherein said supporting member is a rotatable member around which said belt is extended.

9. An apparatus according to claim 1, wherein said belt is an intermediary transfer member onto which the image is transferred from said image bearing member, and the image on said belt is transferred onto a transfer material.

10. An apparatus according to claim 1, wherein said belt is a feeding belt for carrying a transfer material, wherein an image on said image bearing member is transferred onto the transfer material on said belt.

11. A belt moving apparatus comprising:

a movable belt;

a supporting member for supporting said belt, wherein said belt includes a first engaging portion, and said supporting member includes a second engaging portion, and said belt is regulated from laterally shifting by engaging said first engaging portion and said second engaging portion; and a regulating member, disposed out of contact with said belt, for regulating movement of said first engaging portion, wherein said regulating member is disposed so as to be opposed to said first engaging portion with said belt interposed therebetween, and wherein when said belt moves, said regulating member is effective to prevent said first engaging portion from disengaging from said second engaging portion.

12. An apparatus according to claim 11, wherein said regulating member is disposed upstream of a region where said belt is contacted to said supporting member with respect to a movement direction of said belt.

13. An apparatus according to claim 11, wherein said regulating member is a rotatable member.

14. An apparatus according to claim 13, wherein a rotational axis of said regulating member is inclined with respect to a direction perpendicular to a movement direction of said belt.

15. An apparatus according to claim 14, wherein said regulating member is inclined in the direction of urging an end portion of said belt outwardly.

16. An apparatus according to claim 11, wherein a distance from a surface of said belt to said regulating member is smaller than a length of said first engaging portion.

17. An apparatus according to claim 11, wherein said first engaging portion includes a projected portion, and said second engaging portion includes a recessed portion.

18. An apparatus according to claim 11, wherein said supporting member is a rotatable member around which said belt is extended.

19. An apparatus according to claim 1 or 11, wherein said supporting member includes a flange, which includes said second engaging portion.

20. An image forming apparatus comprising:

an image bearing member;

a movable belt, wherein an image on said image bearing member is transferred toward said belt;

a supporting member for supporting said belt, wherein said belt includes a first engaging portion, and said supporting member is provided at an end portion with a second engaging portion, and said belt is regulated from laterally shifting by engaging said first engaging portion and said second engaging portion; and a regulating member, disposed out of contact with said belt, for regulating movement of said first engaging portion, wherein said regulating member is disposed so as to be opposed to said first engaging portion with said belt interposed therebetween, wherein when said belt moves, said regulating member is effective to prevent said first engaging portion from disengaging from said second engaging portion.

21. A belt moving apparatus comprising:

a movable belt;

a supporting member for supporting said belt, wherein said belt includes a first engaging portion, and said supporting member is provided at an end portion with a second engaging portion, and said belt is regulated in a lateral direction from laterally shifting by engagement between engaging said first engaging portion and said second engaging portion; and a regulating member, disposed out of contact with said belt, for regulating movement of said first engaging portion, wherein said regulating member is disposed so as to be opposed to said first engaging portion with said belt interposed therebetween, wherein when said belt moves, said regulating member is effective to prevent said first engaging portion from disengaging from said second engaging portion.

22. An apparatus according to claim 20, or 21 further comprising a flange provided at an end portion of said supporting member, and said flange includes said second engaging portion.

23. An apparatus according to claim 1, 11, 20, or 21 wherein said regulating member is opposed to said second engaging portion with said belt interposed therebetween.

* * * * *

UNITED STATES PATENT AND TRADEMARK OFFICE

CERTIFICATE OF CORRECTION

PATENT NO. : 6,871,038 B2
DATED : March 22, 2005
INVENTOR(S) : Yumi Fujiwara

It is certified that error appears in the above-identified patent and that said Letters Patent is hereby corrected as shown below:

Title page,
Item [75], Inventor, "Yumi Fujiwara, Shizuoka-ken (JP)" should read -- Yumi Fujiwara, Shizuoka (JP) --.
Item [57], ABSTRACT,
Line 8, "portion; a" should read -- portion; and a --.

Column 5,
Line 8, "stretched;" should read -- stretched, --; and
Line 21, "is" should read -- are --.

Column 6,
Line 54, "o" should read -- of --.

Column 7,
Line 31, "is" should read -- are --; and
Line 33, "forced" should read -- force --.

Column 8,
Line 51, "is connected" should be deleted.

Column 12,
Line 18, "because only" should read -- because the only --; and
Line 35, "removed simply" should read -- removed by simply --.

UNITED STATES PATENT AND TRADEMARK OFFICE

CERTIFICATE OF CORRECTION

PATENT NO. : 6,871,038 B2
DATED : March 22, 2005
INVENTOR(S) : Yumi Fujiwara

It is certified that error appears in the above-identified patent and that said Letters Patent is hereby corrected as shown below:

Column 14,
Line 55, "claim 20, or 21" should read -- claim 20 or 21, --; and
Line 59, "or 21" should read -- or 21, --.

Signed and Sealed this

Fourth Day of October, 2005

JON W. DUDAS
*Director of the United States Patent and Trademark Office*